US006102345A

United States Patent [19]

Mori

[11] Patent Number: 6,102,345

[45] Date of Patent: Aug. 15, 2000

[54] ARM SUPPORTING BASE

[75] Inventor: Makoto Mori, Tokyo, Japan

[73] Assignee: Carl Manufacturing Co., Ltd., Tokyo, Japan

[21] Appl. No.: 09/207,463

[22] Filed: Dec. 8, 1998

[30] Foreign Application Priority Data

Dec. 12, 1997 [JP] Japan ..... 9-342634

[51] Int. Cl.[7] ..... B43L 15/00; B41J 11/62

[52] U.S. Cl. ..... 248/118.5; 400/715

[58] Field of Search ..... 248/118.5, 118.1, 248/118.3, 118, 918, 346.01, 415, 416, 349.1, 371, 923, 424, 425, 429, 430; 400/715; 403/59, 61, 70, 164; 108/139, 137, 140, 142

[56] References Cited

U.S. PATENT DOCUMENTS

| | | | |
|---|---|---|---|
| 988,893 | 4/1911 | Packewitz | 248/118.5 |
| 2,307,396 | 1/1943 | Draxler | 108/140 |
| 4,117,627 | 10/1978 | Slingerland | 47/39 |
| 4,549,714 | 10/1985 | Busch | 248/349 |
| 4,708,408 | 11/1987 | Kennon | 312/9 |
| 5,265,835 | 11/1993 | Nash | 248/118.5 X |
| 5,479,867 | 1/1996 | Blevins et al. | 248/349.1 X |
| 5,507,458 | 4/1996 | Campbell et al. | 248/118.3 |
| 5,657,956 | 8/1997 | Smith et al. | 248/349.1 X |
| 5,743,499 | 4/1998 | Wang | 248/118.3 X |
| 5,765,796 | 6/1998 | Lanus | 248/349.1 |
| 5,826,842 | 10/1998 | Paulse et al. | 248/118.1 |
| 5,927,663 | 7/1999 | Tseng | 248/118.5 |

*Primary Examiner*—Leslie A. Braun
*Assistant Examiner*—Michael Nornberg
*Attorney, Agent, or Firm*—Oliff & Berridge, PLC

[57] ABSTRACT

In order to make an arm supporting base small, to enable the arm supporting base to move horizontally and rotatably, to prevent an occurrence of a fatigue of the arm operating a mouse for personal computer and to enhance the efficiency of work, a plurality of ball bearings are interposed between a movable base and a fixed base in such a manner as the movable base is prevented from being removed from the fixed base and the movable base may move in all directions relatively to the fixed base in a certain range.

3 Claims, 4 Drawing Sheets

ARM SUPPORTING BASE

BACKGROUND OF THE INVENTION

1. Field of the Invention

The present invention relates to a supporting means for assisting the movement of a user's arm to facilitate an operation of a mouse.

2. Description of Related Art

In general, computer mouse is carried out such that the mouse is moved on a sponge or rubber pad placed on a desk under a condition that an arm is supported by the desk or is held above the desk. Further a movable base, which is movable in a longitudinal or lateral direction on a plane, may be used so that the mouse is operated with the arm placed on this movable base.

A conventional art of such movable base is shown in FIG. 9, which can be freely moved on a plane. The description will be given below thereto. Rails 100 are first provided in parallel to each other, and movable rails 200 are provided to these rails 100 so as to be movable in a direction indicated by an arrow (a). Further, a movable base 300 is provided to these movable rails 200 so as to be movable in a direction indicated by an arrow (b). In this arrangement, the relative movement of the movable rails 200 in the arrow (a) direction and the relative movement of the movable base 300 in the arrow (b) direction cooperatively causes a horizontal movement of the movable base 300 on the plane (This cooperative movement is referred to as the horizontal movement).

In the conventional example, if the mouse is operated such that an arm operating the mouse is placed on a desk or floated above the desk, fatigue of the arm causes a problem in working efficiency. The use of the support base movable in the longitudinal or lateral direction as shown in FIG. 9 suffers from the problem to be solved mentioned below. When the mouse is moved under a condition that the arm operating the mouse is placed on the movable base during the operation of the personal computer, the movement of the arm needs not only the horizontal movement but also rotational movement around the movable base as its center on the plane. In case this conventional movable base is used to operate the mouse, this movable base, which does not rotate on the plane, makes it difficult to operate the mouse and rather leads to the arm fatigue. Therefore, a problem in working efficiency to be solved is raised.

When the lengths of the rails 100 and the movable rails 200 are, for instance, set substantially equal to each side of the movable base 300 to make the entire size small in FIG. 9, the practical utility lacks since the movable range of the movable base 300 on the plane becomes narrower. In case where the lengths of the rails 100 and the movable rails 200 are set long relative to the movable base 300 as shown in the Figure, the length of the rails is longer than the length of the arm from the elbow to the hand holding the mouse, and hinders the operation of the mouse. Consequently, a problem in working efficiency is caused.

Further, the present invention is not limited to the mouse for personal computer, and may be used in other application relating to a work to be done on a desk while laying an arm thereon such as drafting a drawing, writing a note and the like.

SUMMARY OF THE INVENTION

An object of the present invention is to provide an arm supporting base, in which its size is compact and it is possible to move horizontally and rotationally to prevent an occurrence of fatigue of an arm operating a mouse thereby to increase a working efficiency.

In the first feature of the present invention, the arm supporting base comprising a fixed base, at a center portion of which a circular hole is formed, a movable base disposed above the fixed base and on the bottom of which a boss being protruded through the circular hole is provided, at least three ball bearings provided on the fixed base around the hole, and a back plate larger in diameter than the hole to be fixed to the protruded tip end of the boss beneath the circular hole.

In the second feature of the present invention, two circular holes in which the movement of the movable base is allowed are formed at right and left portions of the elliptic fixed base, a plurality of ball bearings are provided around the respective circular holes, the elliptic movable base is put on the ball bearings and the horizontal movement of the movable base to the fixed base may be realized within the area of the circular holes.

DETAILED DESCRIPTION OF THE PREFERRED EMBODIMENTS

Preferred embodiments according to first to second features of the present invention will be briefly described with reference to the accompanying drawings.

Figure 2:
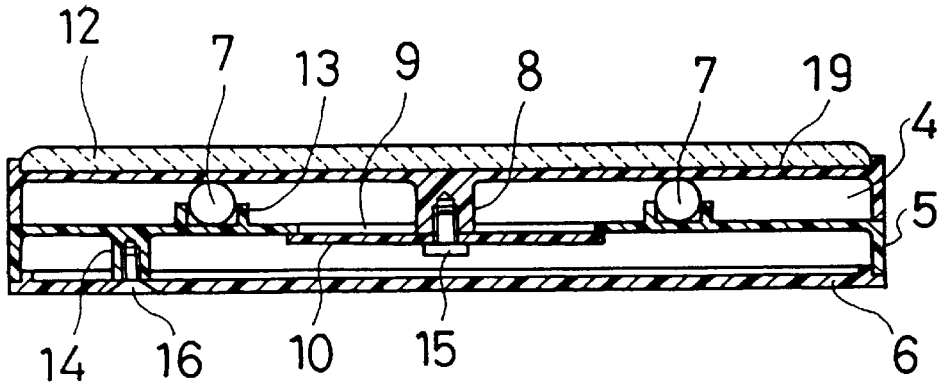
FIG. 2 is a vertically sectional view showing an arm supporting base in FIG. 1.

In the first embodiment of the present invention, an arm supporting base is arranged in such a manner, as shown in FIG. 2, that a movable base 4 is supported on a fixed base 5 through balls 7 interposed between the movable base 4 and the fixed base 5, a boss 8 is protruded at a center of the movable base 4 through a circular hole 9 larger in diameter than the one of the boss 8 is opened in the fixed base 5, and a back plate 10 larger in diameter than the hole 9 is fixed to the tip end of the boss 8. Further, a height $H_1$ of the boss 8, as shown in FIG. 3, is set so as to form a slight clearance between the back plate 10 fixed to the boss 8 and a back surface of the fixed base 5.

Figure 1:
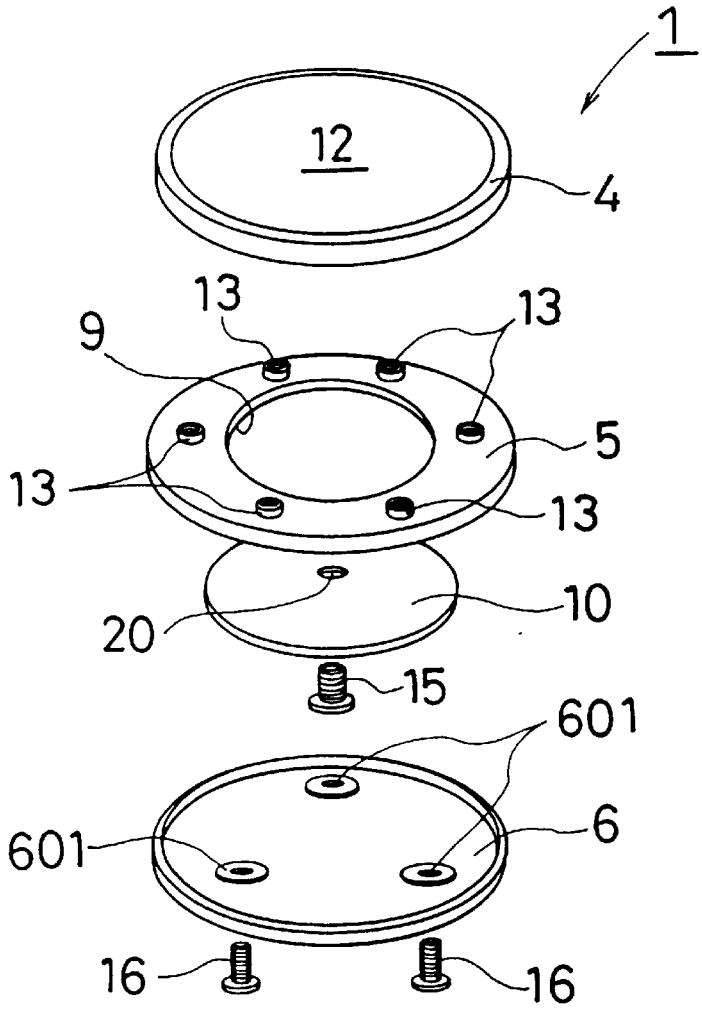
FIG. 1 is an exploded perspective view showing an assembly of an embodiment of the present invention.

Next, the description will be given with respect to the arm supporting base 1. In FIG. 1, the ball bearings are provided on the fixed base 5, the movable base 4 is put on these balls 7, and then a back plate 10 is fixed to the tip end of the boss 8 with a screw 15, so that the movable base 4 is prevented from being removed from the fixed base 5. A height $H_2$ (see FIG. 3) of a flange of the movable base 4 and a diameter of each of the balls 7 are determined in such a manner as a slight clearance is formed between a lower edge 17 (see FIG.

3) of the flange of the movable base 4 and an upper surface of the fixed base 5 in this condition. The height $H_1$ of the boss 8 in FIG. 3 is so determined that a slight clearance is formed between the back plate 10 and a back surface 501 (see FIG. 5) of the fixed base 5 under a condition that the movable base 4 is placed on the balls 7 and the back plate 10 is fixed to the boss 8 with the screw 15 as shown in FIG. 2.

Figure 3:
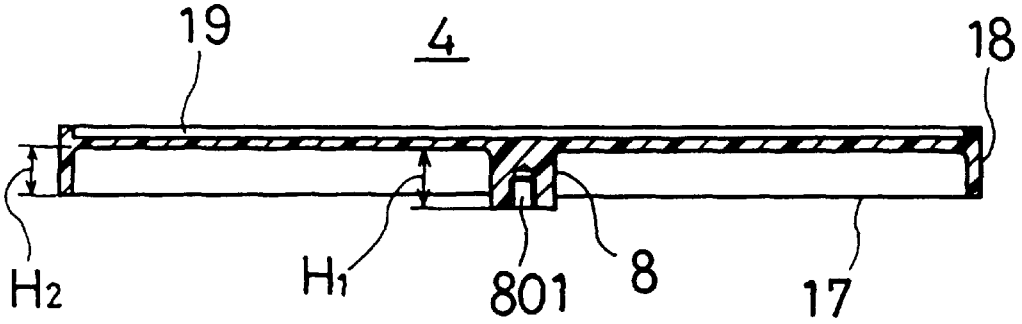
FIG. 3 is a vertically sectional view showing a movable base in FIG. 2.

As shown in FIG. 3, the sectional shape of the movable base 4 is of a dish having a flange 18 of the height $H_2$ so that the movable base 4 hides the balls 7 in such a manner that the balls 7 are prevented from being viewed externally to thereby improve the external appearance, and the movable base 4 moves rotatably more on the balls 7 to thereby make the parallel and rotational movements on a plane freely within the range of the circular hole 9. The upper surface 19 is recessed, so that a pad 12 (see FIG. 2) can be attached thereto. The boss 8 is formed at a center of the movable base 4, and a threaded hole 801 is formed in this boss 8 (see FIG. 3).

Figure 5:
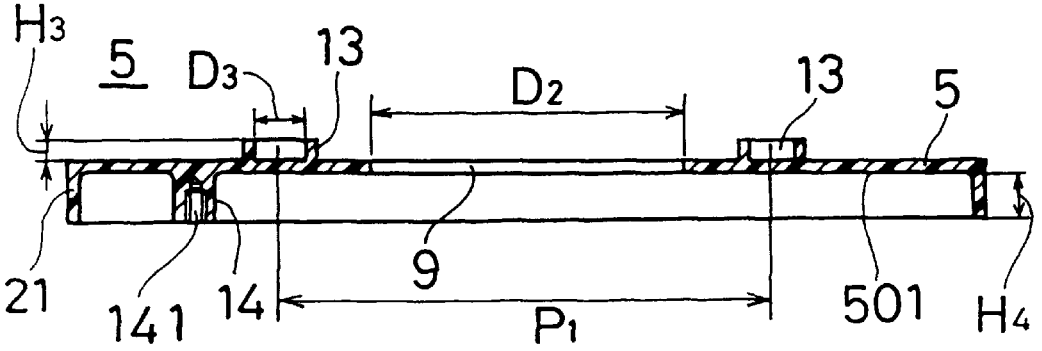
FIG. 5 is a vertically sectional view showing a fixed base in FIG. 2.

As shown in FIG. 5, the sectional shape of the fixed base 5 is of a dish having a flange 21 of the height $H_4$ so as to define a space in which the back plate 10 is movable. As shown in FIGS. 1 and 5, the circular hole 9 having the diameter $D_2$ larger than the diameter of the boss 8 is provided at a center of the fixed base 5, and a plurality of the ball bearings are disposed around this circular hole 9. If the inner side of the flange 18 is brought into contact with the ball bearings during the movement of the movable base 4 placed on the balls 7, the smooth movement of the movable base 4 owing to the balls 7 is lessened. For this reason, the diameter of the boss 8, the diameter $D_2$ of the hole 9 and the pitch circle diameter $P_1$ of the ball bearings are so determined as to prevent the inner circumferential surface of the flange 18 from being contacted with the ball bearings. That is to say, the inner circumferential surface of the flange 18 is not contacted with the ball bearings under a condition that the boss 8 is contacted with the inner edge of the circular hole 9 during the movement of the movable base 4.

The inner diameter $D_9$ of each of receptacles 13 of the ball bearings is slightly larger than the diameter of the ball 7, and the depth $H_8$ thereof in equal to or slightly larger than the radius of the ball 7. With this arrangement, the ball 7 can roll smoothly within the ball receptacle 13, and the simple assembly can be made by merely falling the ball 7 into the ball receptacle 13 to make the ball bearings.

Figure 4:
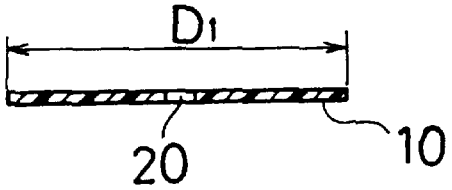
FIG. 4 is a vertically sectional view showing a back plate in FIG. 2.

As shown in FIG. 4, the diameter $D_1$ of the back plate 10 is larger than the diameter $D_2$ of the circular hole 9 to prevent the back plate 10 from being pulled out through the circular hole 9, wherever the movable base 4 is located. The back plate 10 is fixed to the tip end of the boss 8 with the screw 15 as shown in FIG. 2. Thus, the movable base 4 and the fixed base 5 are unified together. As shown in FIGS. 1 and 5, by arranging the ball bearings around the circular hole 9 with the pitch circle diameter $P_1$ at the same angular intervals, the inclination of the movable base 4 can be avoided in the case where the boss 8 is contacted with the inner edge of the circular hole 9, i.e., in the case where the movable base 4 is most offset from the fixed base 5. The back plate 10 is also designed to avoid the inclination of the movable base 4. In FIG. 4, the back plate 10 is formed at its center with a screw passing hole 20.

Figure 6:
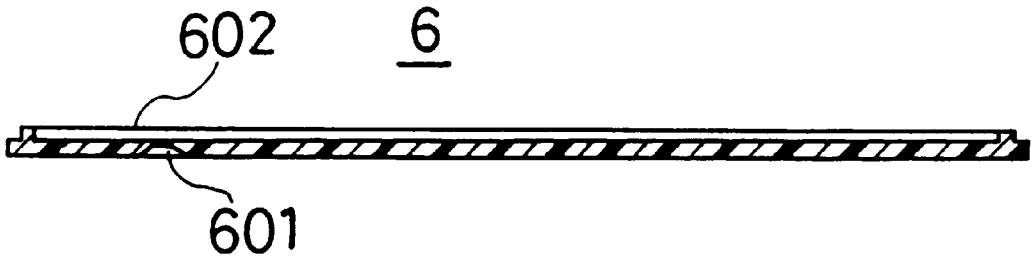
FIG. 6 is a vertically sectional view showing a bottom plate in FIG. 2.

As shown in FIG. 5, a boss 14 having the same height as the height $H_4$ of the flange 21 is provided on the back surface of the fixed base 5. This boss 14 is positioned so as not to be contacted with the outer periphery of the back plate 10 under a condition that the boss 8 shown in FIG. 3 is contacted with the inner edge of the circular hole 9. This permits the free movement of the boss 8 within the circular hole 9. The boss 14 is provided with a threaded hole 141. As shown in FIG. 6, a bottom plate 6 is provided with a screw passing hole 601 passing therethrough, and a flange 602 is formed, which is fitted into the inner edge of the flange 21 of the fixed base 5.

Next, the assembling process will be described with reference to FIG. 1. The balls 7 are first fallen into the ball receptacle 13 to make the ball bearings and then covered by the movable base 4 placed thereon in such a manner as the boss 8 is protruded through the circular hole 9. The back plate 10 is fixed to the tip end of the boss 8 with the screw 15 under this condition. In the case of the embodiment shown in FIG. 1, the bottom plate 6 is fixed to the bosses 14 with the screws 16 while being contacted with the fixed base 5 through the ball bearings.

Next, the effect of the embodiments thus constructed will be described. The description will be given with respect to the arm supporting base 1 first. In case where the mouse is operated with the arm placed on the pad 12 shown in FIG. 2, the movable base 4 moves as follows: That is, since the movable base 4 is supported on the fixed base 5 with the balls 7 interposed between the fixed base 5 and the movable base 4, the movable base 4 may move horizontally in parallel with the fixed base 5 in association with the horizontal movement of the arm. If the hand makes such movement as to operate the mouse right and left, the movable base 4 is free responded to the mouse operation. In association with the motion of the hand, the movable base 4 can make both the horizontal and rotational movements on the fixed base 5.

The boss 8 is protruded at the center of the movable base 4 through the circular hole 9 of the fixed base 5 larger in diameter than the boss 8, and the boss 8 is located within this circular hole 9. This arrangement permits the boss 8 to freely move within the circular hole 9 provided in the fixed plate 5 without restriction against the above-noted movements of the movable base 4, as well as delimits the movable range of the boss 8 to prevent the movable base 4 from being pulled out from the fixed base 5.

The back plate 10 larger in diameter than this circular hole 9 is fixed to the boss 8, and the height $H_1$ (see FIG. 3) of the boss 8 is set so that a slight clearance is formed between the back plate 10 fixed to this boss 8 and the back surface 501 (see FIG. 5) of the fixed base 5. This can permit the movement of the movable base 4 while associating the fixed base 5 and the movable base 4 by the back plate 10. In such manner, the ball bearings are interposed between the movable base 4 and the fixed base 5, the boss 8 provided on the movable base 4 is permitted to freely move within the circular hole 9 opened in the fixed base 5, the movable range of the movable base 4 is delimited without restricting the smooth movement of the movable base 4, and the movable base 4 and the fixed base 5 are unified together by the back plate 10. Therefore, the balls 7, the boss 8, the circular hole 9 and the back plate 10 can be accommodated in the inside of the movable base 4 and the fixed base 5, and the movable range of the movable base 4 can be set largely while making the entire size compact.

Figure 7:
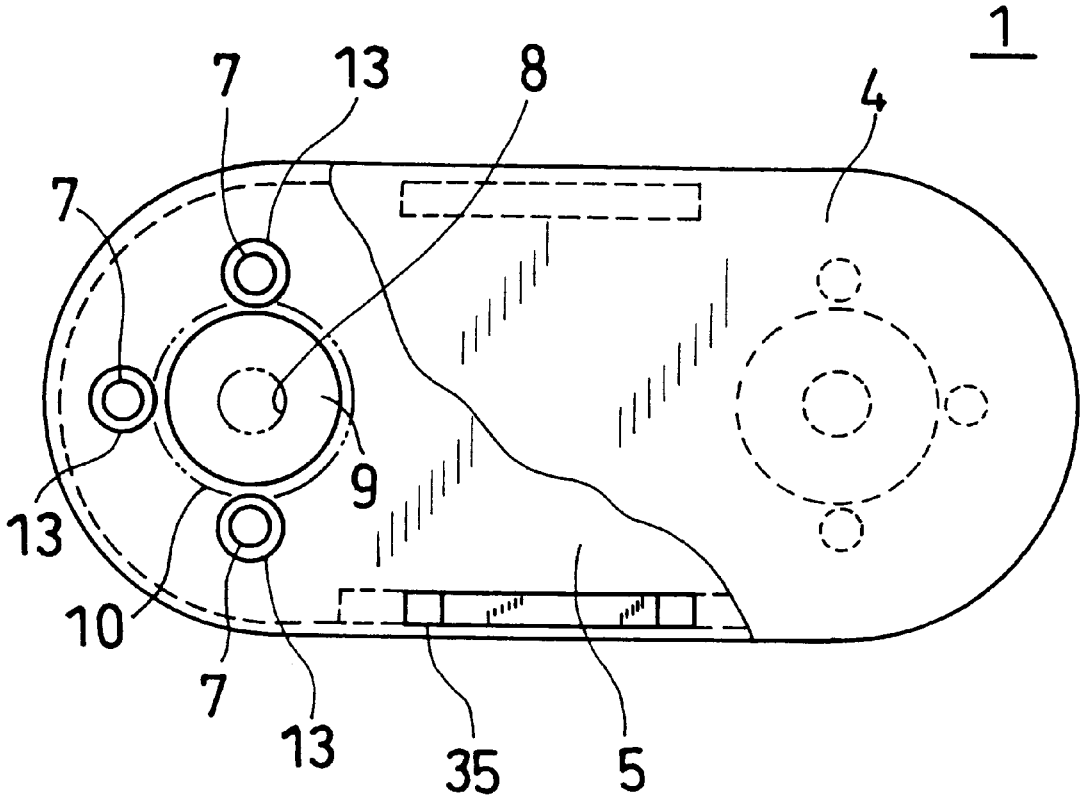
FIG. 7 is a plan view showing another embodiment of the present invention.

In the second embodiment of the present invention, as shown in FIG. 7, the arm supporting base 1 comprises circular holes 9 in which the movement of the movable base 4 is allowed are formed at right and left portions of the elliptic fixed base 5, a plurality of ball bearings provided around the respective circular holes 9 and the elliptic movable base 4 put on the ball bearings. In FIG. 7, the numeral sign 35 indicates a fixing-hole for fixing the arm supporting base 1 to the desk or the like. In this embodiment, since a plurality of ball bearings are disposed at left and right portions of the fixed base 5, the load of arm operating the mouse is dispersed at each bearing. Therefore, the more efficient movement of the arm operating the mouse may be realized.

Figure 8:
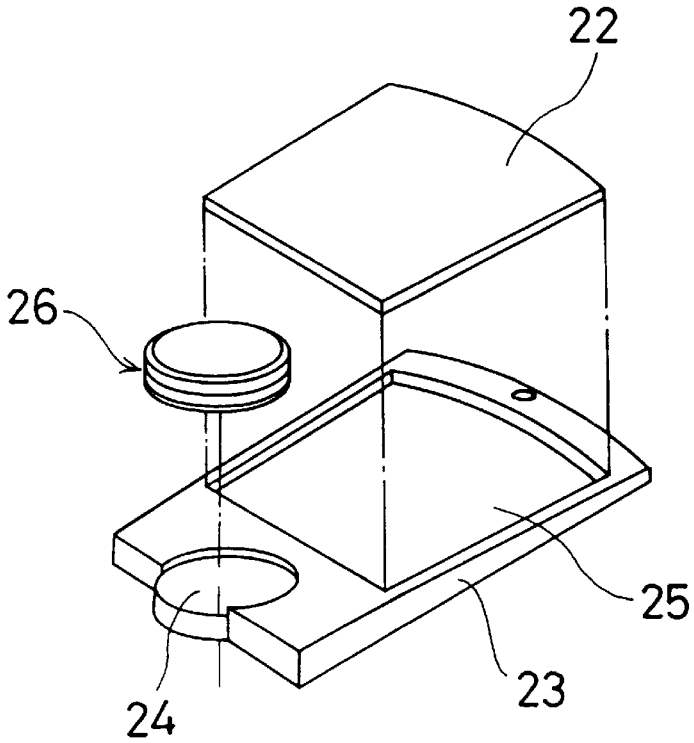
FIG. 8 is an exploded perspective view showing an assembly of one use example of the present invention.
Figure 9:
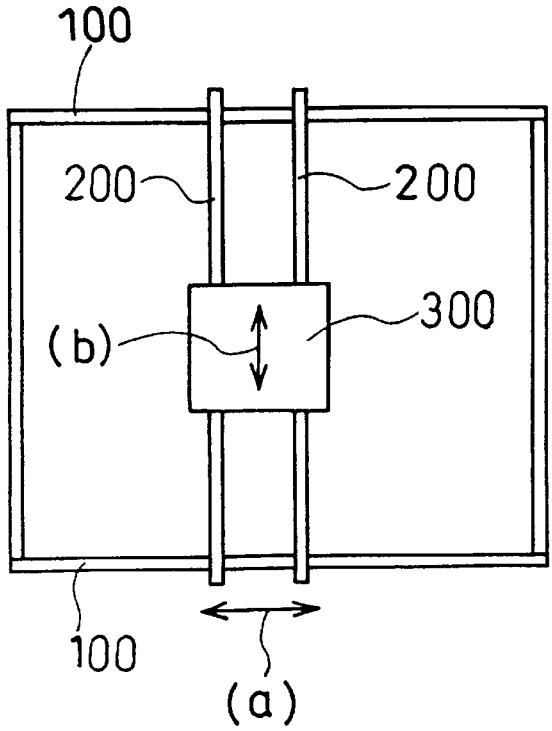
FIG.9 (Prior Art)
FIG. 9 is a plan view of a conventional art.

FIG. 8 shows how to use a use example of the present invention in which a supporting base fitting recess 24 for fittingly mounting the arm supporting base 26 is provided in an end of a plate-like mat base 23, and a pad holding recess 25 for holding a mouse pad 22 is provided adjacent to the supporting base fitting recess 24.

According to the first feature of the present invention, the hole is provided in the fixed base, a plurality of the ball bearings are provided around the circular hole, and the movable base is put on the balls received in the ball receptacles, so that the movable base is supported to make the horizontal movement on the plane with respect to the fixed base as well as to make the own rotation of the movable base. The boss is protruded at the center of the movable base through the circular hole 9, the back plate larger in diameter than the circular hole is fixed to the boss, the height of the boss is set so as to form a slight clearance between the back plate fixed to the boss and the back surface of the fixed base, and the boss is permitted to move within the circular hole, so that the movable range of the movable base is delimited without restricting the movement of the movable base, and the fixed base and the movable base are unified together by the back plate. Thus, the mouse operation can be facilitated with the arm placed on the movable base to prevent an occurrence of the fatigue of the arm and enhance the working efficiency.

According to the second feature of the present invention, the arm supporting base comprises circular holes in which the movement of the movable base is allowed are formed at right and left portions of the elliptic fixed base, a plurality of ball bearings provided around the respective holes and the elliptic movable base put on the ball bearings. Since a plurality of ball bearings are disposed at right and left portions of the fixed base, the load of arm operating the mouse is dispersed at each bearing. Therefore, the more efficient movement of the arm operating the mouse may be realized.

What is claimed is:

1. An arm supporting base, comprising:

an elliptic fixed base, in which a circular hole is formed;

an elliptic movable base, which is disposed above the fixed base having a boss protruded down through the circular hole, the boss allowing the movable base to move freely in two dimensions;

at least three ball bearings provided on the fixed base around the hole;

a back plate larger in diameter than the circular hole to be fixed to a tip end of the boss beneath the circular hole;

a second circular hole in the fixed base such that the first circular hole and the second circular hole are formed at opposite portions along the long axis of the fixed base, the movable base has a second boss protruded down through the second circular hole; and a second back plate larger in diameter than the second circular hole to be fixed to a tip end of the second boss beneath the second circular hole.

2. The arm supporting base of claim 1, wherein the circular hole is formed in the center of the fixed base.

3. An arm supporting base, comprising:

a fixed base, with a plurality of circular holes offset from the center of the base;

a movable base, which is disposed above the fixed base having a plurality of bosses, a boss protruding down through each circular hole of the plurality of circular holes;

the plurality of bosses allowing the movable base to move in two dimensions;

at least three ball bearings provided on the fixed base; and a plurality of back plates larger in diameter than the circular holes, a back plate fixed to a tip end of each boss beneath the circular hole.

* * * * *